US005238595A

United States Patent [19]

Crutcher et al.

[11] Patent Number: 5,238,595

[45] Date of Patent: Aug. 24, 1993

[54] DETERGENT BUILDER

[75] Inventors: Terry Crutcher; Joe D. Sauer; Kim R. Smith; James E. Borland, all of Baton Rouge, La.

[73] Assignee: Ethyl Corporation, Richmond, Va.

[21] Appl. No.: 810,197

[22] Filed: Dec. 19, 1991

[51] Int. Cl.[5] ..... C11D 1/18; C11D 17/00

[52] U.S. Cl. ..... 252/174.25; 252/547; 252/DIG. 1

[58] Field of Search ..... 252/174.25, 547, DIG. 1

[56] References Cited

U.S. PATENT DOCUMENTS 4,405,483 9/1983 Kuzel et al. ..... 252/174.25
4,446,035 5/1984 Barrat et al. ..... 252/547
4,457,856 7/1984 Mitchell et al. ..... 252/174.25
4,548,744 10/1985 Connor ..... 252/547
4,574,052 3/1986 Gupte et al. ..... 252/174.25
4,581,153 4/1986 Trabitzsch et al. ..... 252/174.25
4,597,898 7/1986 Vander Meer ..... 252/547
4,661,288 4/1987 Rubingh et al. ..... 252/547

*Primary Examiner*—Patrick P. Garvin
*Assistant Examiner*—E. D. Irzinski
*Attorney, Agent, or Firm*—Patricia J. Hogan

[57] ABSTRACT

The divalent ion sequestration rate of a zeolite is increased by blending it with an amine oxide corresponding to the formula RR'R"NO in which R is a primary alkyl group containing 6–24 carbons and R' and R" are independently selected from methyl, ethyl, and 2-hydroxyethyl to provide about 2.3–7.0 mmols of amine oxide per gram of zeolite. Preferred ingredients are zeolite A and N-tetradecyldimethylamine oxide, and the increased sequestration rate makes the zeolite more suitable for use as detergent builder in anionic surfactant-containing cleaning compositions.

11 Claims, No Drawings

DETERGENT BUILDER

FIELD OF INVENTION

This invention relates to zeolite compositions having improved detergent builder properties.

BACKGROUND

It is known that anionic surfactants can be usefully employed alone or in conjunction with nonionic surfactants, such as amine oxides, in claning compositions, such as laundry detergents and hard surface cleaners. Since the presence of divalent ions, particularly calcium in the water may cause anionic surfactants to be precipitated from solution before the cleaning process is complete, they are conventionally used together with detergent builders, such as sodium tripolyphosphate, zeolite A, or other aluminosilicate, to minimize the precipitation.

In order to be most effective, the builders generally have to function adequately in the first two minutes of detergent use. Phosphate builders sequester divalent ions quickly enough to be satisfactory in this regard, but zeolite builders require a longer time to effect adequate sequestration, especially at the lower wash temperatures (30–40° C.) frequently used today. It would be desirable to increase the divalent ion sequestration rate of zeolite builders.

SUMMARY OF INVENTION

It has been found that the divalent ion sequestration rate of a zeolite can be increased by blending it with an amine oxide corresponding to the formula RR'R''NO in which R is a primary alkyl group containing 6–24 carbons and R' and R'' are independently selected from methyl, ethyl, and 2-hydroxyethyl so as to provide about 2.3–7.0 mmols of amine oxide per gram of zeolite.

DETAILED DESCRIPTION

Amine oxides which can be used in the practice of the invention are compounds corresponding to the formula RR'R''NO in which R is a primary alkyl group containing 6–24 carbons, preferably 10–18 carbons, and R∝ and R'' are independently selected from methyl, ethyl, and 2-hydroxyethyl. The preferred amine oxides are those in which the primary alkyl group has a straight chain in at least most of the molecules, generally at least 70%, preferably at least 90% of the molecules; and the amine oxides which are especially preferred are those in which R contains 10–18 carbons and R' and R'' are both methyl.

Exemplary of the preferred amine oxides are the N-hexyl-, N-octyl-, N-decyl-, N-dodecyl-, N-tetradecyl-, N-hexadecyl-, N-eiccosyl-, N-docosyl-, and N-ttracosyldimethylamine oxides, the corresponding amine oxides in which one or both of the methyl groups are replaced with ethyl or 2-hydroxyethyl groups, etc., and mixtures thereof. A particularly preferred amino oxide is N-tetradecyldimethylamine oxide.

The zeolite employed in the builder system may be a natural or synthetic zeolite, i.e., a crystalline aluminosilicate corresponding to the formula $xM_{2/n}O.Al_2O_3.ySiO_2.zH_2O$ in which M is a cation, generally an ammonium, alkali metal, or alkaline earth metal cation; n is the valence of the cation; x is the coefficient of the metal oxide; y is the coefficient of silica; and z is the number of molecules of water of hydration. It is preferably a sodium aluminosilicate, more preferably zeolite A, X, or Y, most preferably zeolite A.

The builder systems of the invention contain 2.3–7.0, preferably 3.1–5.4, more preferably 3.5–4.7, and most preferably about 3.9 mmols of the amine oxide per gram of the zeolite. Smaller amounts of amine oxide provide no increase in the sequestration rate, while larger amounts provide smaller increases than the amounts used in the present builder systems.

In preparing the builder systems, it is important to blend the amine oxide and zeolite so s to form a powder rather than a paste. The formation of a paste can be avoided by using a solid amine oxide or an aqueous amine oxide having a water content low enough to prevent the amine oxide/zeolite mixture from containing more than about 30% by weight of water.

The amine oxide/zeolite builder systems of the invention may be incorporated into an ionic surfactant-containing cleaning compositions in the same manner as conventional detergent builders to produce formulations from which the anionic surfactants are less apt to precipitate prematurely. Such cleaning compositions include:

(A) hard surface cleaners, which typically comprise 1–25% by weight of one or more surfactants; 0–25% by weight of one or more bleaching agents, such as sodium percarbonate or perborate; 1–20% by weight of a pH modifier, such as sodium silicate; 10–80% by weight of one or more processing aids, such as sodium sulfate or sodium carbonate; and 1–50% by weight of the builder, and (B) laundry detergent powders, which typically have the same ingredients as the hard surface cleaners in essentially the same proportions but also contain 0.5–5% by weight of one or more anti-redeposition agents, such as sodium carboxy methyl cellulose and sodium acrylates.

The anionic surfactant which is used in conjunction with one of the novel builder systems may be any of the anionic surfactants typically employed in cleaning compositions but is usually an alkyl sulfate, alkyl ether sulfate, sulfonate, sulfosuccinate, or sarcosinate surfactant. As is known, these surfactants are ordinarily alkali metal or ammonium salts which contain detergent-range alkyl groups, i.e., alkyl groups containing 8–18 carbons; and they include, e.g., sodium lauryl sulfate, sodium lauryl ether sulfates, sodium dodecylbenzenesulfonate, nonylphenoxysulfosuccinate, and sodium laryl sarcosinate.

The invention is advantageous in that the use of the amine oxide in conjunction with the zeolite increases the divalent ion sequestering rate of the zeolite and thereby minimizes premature precipitation of an anionic detergent from solution when the mixture is utilized as a builder system in a cleaning composition.

The following example is given to illustrate the invention and is not intended as a limitation thereof. Unless otherwise specified, quantities mentioned in the example are quantities by weight.

EXAMPLE

Part A—Control

Stir a 250 mL solution of water containing 500 ppm of calcium with 0.10 g of zeolite A for 20 minutes at 22° C. while monitoring the amount of calcium remaining in solution with a calcium ion selective electrode. At the end of the 20-minute period, there is a 100 ppm decrease in the calcium content of the solution, but no significant uptake of calcium by the zeolite A is noted at the critical two-minute point.

Part B—Control

Repeat Part A except for replacing the 0.10 g of zeolite A with 0.10 g of N-tetradecyldimethylamine oxide ($C_{14}AX$). The ultimate uptake of calcium is 30 ppm, all of which is taken up during the first two minutes.

Part C—Control

Repeat Part A except for replacing the 0.10 g of zeolite A with 0.20 g of a 25/75 blend of $C_{14}AX$ and zeolite A (1.3 mmols of amine oxide/gram of zeolite). As is Part A, there is a 100 ppm decrease inn the calcium content of the solution at the end of the 20-minute period but no measurable amount of calcium uptake during the first two minutes.

Part D—Control

Repeat Part C except for using a 3/1 blend of $C_{14}AX$ and zeolite A (11.7 mmols of amine oxide/gram of zeolite). The ultimate uptake of calcium is 10 ppm, all of which is taken up during the first two minutes.

Part E

Repeat Part C except for using a 1/1 blend of zeolite A and $C_{14}AX$ (3.9 mmols of amine oxide/gram of zeolite). As in Parts A and C, there is a 100 ppm decrease in the calcium content of the solution at the end of the 20-minute period. However, the majority of the calcium uptake, i.e., 70 ppm, occurs by the critical two-minute point.

What is claimed is:

1. A mixture suitable for use as a detergent builder and consisting of (A) a zeolite, (B) about 2.3–7.0 mmols per gram of zeolite of an amine oxide corresponding to the formula RR'R''NO in which R is a primary alkyl group containing 6–24 carbons and R' and R'' are independently selected from the group consisting of methyl, ethyl, and 2-hydroxyethyl, and (C) 0–30% of water, based on the weight of the mixture.

2. The mixture of claim 1 wherein R is a primary alkyl group containing 10–18 carbons and R' and R'' are methyl.

3. The mixture of claim 2 wherein the amine oxide is N-tetradecyldimethylamine oxide.

4. The mixture of claim 1 wherein the zeolite is a sodium aluminosilicate.

5. The mixture of claim 1 wherein the zeolite is zeolite A.

6. The mixture of claim 1 wherein the amount of amine oxide is 3.1–5.4 mmols per gram of zeolite.

7. The mixture of claim 6 wherein the amount of amine oxide is 3.5–4.7 mmols per gram of zeolite.

8. The mixture of claim 7 wherein the amount of amine oxide is about 3.9 mmols per gram of zeolite.

9. The mixture of claim 8 wherein the amine oxide is N-tetradecyldimethylamine oxide and the zeolite is zeolite A.

10. A process for increasing the divalent ion sequestration rate of a zeolite, said process comprising blending the zeolite with an amine oxide corresponding to the formula RR'R''NO in which R is a primary alkyl group containing 6–24 carbons and R and R'' are independently selected from methyl, ethyl, and 2-hydroxyethyl to provide a powder containing about 2.3–7.0 mmols of amine oxide per gram of zeolite.

11. A cleaning composition comprising an aqueous anionic surfactant and a detergent builder consisting of a zeolite and about 2.3–7.0 mmols per gram of zeolite of an amine oxide corresponding to the formula RR'R''NO in which R is a primary alkyl group containing 6–24 carbons and R' and R'' are independently selected from the group consisting of methyl, ethyl, and 2-hydroxyethyl.

* * * * *